United States Patent [19]

Layton et al.

[11] 4,308,513

[45] Dec. 29, 1981

[54] ETCHED MAGNETIC COIL

[75] Inventors: Wilbur T. Layton, San Diego; Clyde Zachry, Poway, both of Calif.

[73] Assignee: Burroughs Corporation, Detroit, Mich.

[21] Appl. No.: 185,218

[22] Filed: Sep. 8, 1980

Related U.S. Application Data

[63] Continuation of Ser. No. 955,091, Oct. 26, 1978, abandoned.

[51] Int. Cl.[3] ..... H01F 27/30

[52] U.S. Cl. ..... 336/200; 336/223

[58] Field of Search ..... 336/200, 205, 206, 223, 336/224

[56] References Cited

U.S. PATENT DOCUMENTS

| | | | |
|---|---|---|---|
| 2,597,237 | 5/1952 | Friend | 336/224 X |
| 3,267,402 | 8/1966 | Reimer | 336/200 |

FOREIGN PATENT DOCUMENTS

| | | | |
|---|---|---|---|
| 214512 | 4/1961 | Austria | 336/206 |
| 2543762 | 4/1976 | Fed. Rep. of Germany | 336/223 |
| 31075 | 9/1964 | German Democratic Rep. | 336/200 |
| 447377 | 3/1968 | Switzerland | 336/200 |
| 221594 | 9/1924 | United Kingdom | 336/205 |

OTHER PUBLICATIONS

IBM Technical Disclosure Bulletin, "Flexible Circuit Solenoid," Gonnella et al. vol. 16, No. 9, Feb. 1974.

IBM Technical Disclosure Bulletin, "Printed Circuit Coil," Moreno, vol. 12, No. 6, Nov. 1969.

*Primary Examiner*—Thomas J. Kozma

*Attorney, Agent, or Firm*—John J. McCormack; Nathan Cass; Kevin R. Peterson

[57] ABSTRACT

A method of forming an electrical coil and the coil formed thereby wherein flat, thin conductors are formed on a flexible dielectric substrate with one end of each conductor formed offset to overlie an adjacent conductor; by selectively bending the substrate, the offset conductor ends contact the adjacent conductors to form continuous turns; and by suitably trimming the conductor a relatively thin, flat coil is formed whose wall thickness is small compared to wire wound coils having the same number of turns. This coil is particularly useful in bubble memories.

9 Claims, 7 Drawing Figures

ETCHED MAGNETIC COIL

This is a continuation of application Ser. No. 955,901, filed Oct. 26, 1978, now abandoned.

BACKGROUND OF THE INVENTION

This invention relates, in general, to a method of forming electrical inductance coils and the electrical coils formed thereby which are particularly useful in providing the rotating in-plane magnetic field for the propagation of bubbles in bubble memories.

There are a number of prior patents relating to the formation of coils of various types by utilizing printed circuit techniques, typical examples of which are the U.S. patents to Shortt, et al., U.S. Pat. No. 3,002,260, Wilburn, U.S. Pat. No. 3,633,273 and other patents showing laminated sheet coils such as the Lohman U.S. Pat. No. 3,320,566 and in this general field a method of manufacturing electrical condensors with metalized coating on a paper strip is shown in the Dubilier U.S. Pat. No. 2,716,180. However, notwithstanding this prior art, there exists a requirement for an electrical coil which has a high packing coefficient, which is cost effective, and which has the additional advantage of allowing design choices, such as, changing the pitch of the coils to vary the induced magnetic field strength and to change the distributed capacitance of the coil.

These requirements for the coil, i.e., high packing coefficient, reduced costs, and choice of design are particularly important in the field of bubble memories where the in-plane magnetic field is produced by two or more coils surrounding a magnetic substrate capable of supporting bubbles therein. For a high packing coefficient, the thickness of the conductors which are formed into a coil must be small if the package is to be small and the coils brought close to this magnetic substrate and for cost effectiveness the coils can be formed utilizing printed circuit techniques along with other items made for bubble memories using these same techniques.

Accordingly, it is a primary object of this invention to provide a new and improved method of forming a magnetic coil.

A second object of this invention is to provide a new and improved coil of reduced thickness to provide a smaller cross-sectional area and to bring the coil closer to the item being subjected to the induced magnetic field.

Still another object of this invention is to provide a cost effective coil which still meets the foregoing objects.

Still another object of this invention is to provide a coil which allows a choice of design such as the change of pitch to vary the induced magnetic field strength in different areas of the coil and to change the distributed capacitor characteristics of the coil.

Another advantage will be apparent to those skilled in the art on a reading of the following description of the invention in that this coil, and the method of making same, may be utilized where the core or sub-assembly about which the coil is to be placed will not permit the utilization of a prewound or preformed coil. The present invention overcomes this deficiency by being able to be formed in place over the coil or subassembly.

Accordingly, still another object of this invention is to provide a coil and the method of making same where the coil may be formed in place over the core or subassembly thereby overcoming a deficiency of preformed coils.

SUMMARY OF THE INVENTION

The invention which meets the foregoing objects comprises a method of forming an electrical coil and the coil formed thereby wherein flat, thin, spaced apart, parallel conductors of rectangular cross-section are formed on a flexible dielectric substrate with one end with each of the conductor strips formed first diagonally then offset in alignment with an adjacent parallel strip, providing a first compound bent at the end of the diagonal portion and transverse thereto, so that the diagonals are vertical to the remainder of the conductors and the parallel ends which are in alignment with the adjacent conductors are spaced therefrom, then bending the conductors so as to form the inside coil area of a size necessary to envelope the item to be subject to the magnetic field with the ends of the remainder of the conductors overlapping the terminal ends and extending out and beyond the terminal ends, then connecting the terminal ends to the conductors by any suitable means such as flow soldering, welding or the like, and trimming all the conductors, except the outer two conductors to form the input and output coil conductors.

The coil formed by the foregoing method is a unitary, relatively thin coil with flat conductors formed on a sheet of dielectric material whose conductor thickness is relatively small compared to a wire wound coil having the same number of turns and current carrying capability.

BRIEF DESCRIPTION OF THE PREFERRED EMBODIMENT

Figure 1:
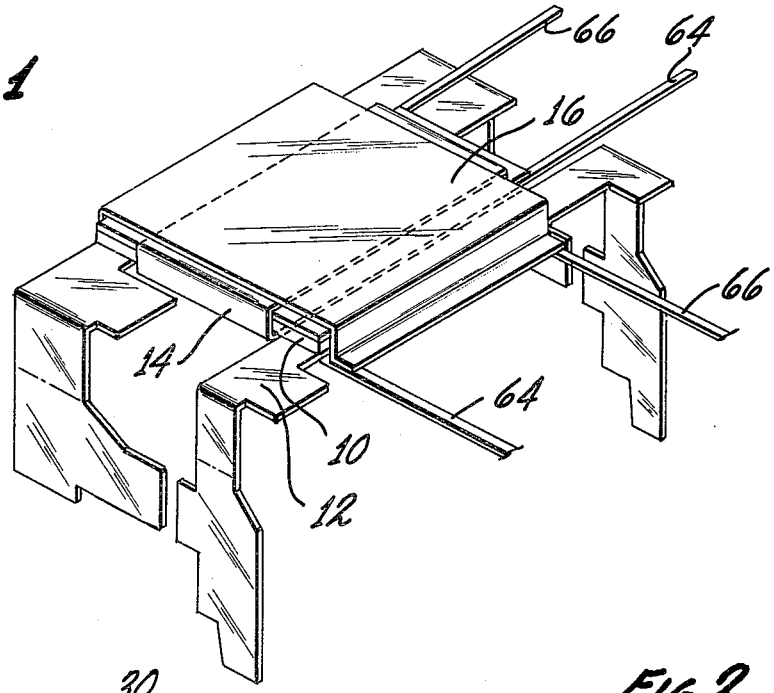
FIG. 1 is a perspective view of a portion of a bubble memory.

FIG. 1 shows an envelope 10 containing one or more magnetic bubble chips with a flexible printed circuit board 12 having conductors for connecting the chips to each other (if there is more than one) and to other electronic devices and to a power source for providing the rotating in-plane magnetic field produced by coils 14 and 16 formed by the method disclosed herein. These coils may be made by the same printed circuit techniques as used in making the flexible circuit board 12 shown in this Figure. This Figure also shows an important advantage of the invention in that these coils can be formed over the envelope 10 with the circuit board 12 also in place. This cannot be done by a prewound wire coil because of the interference of the extensions on the board 12.

Figure 2:
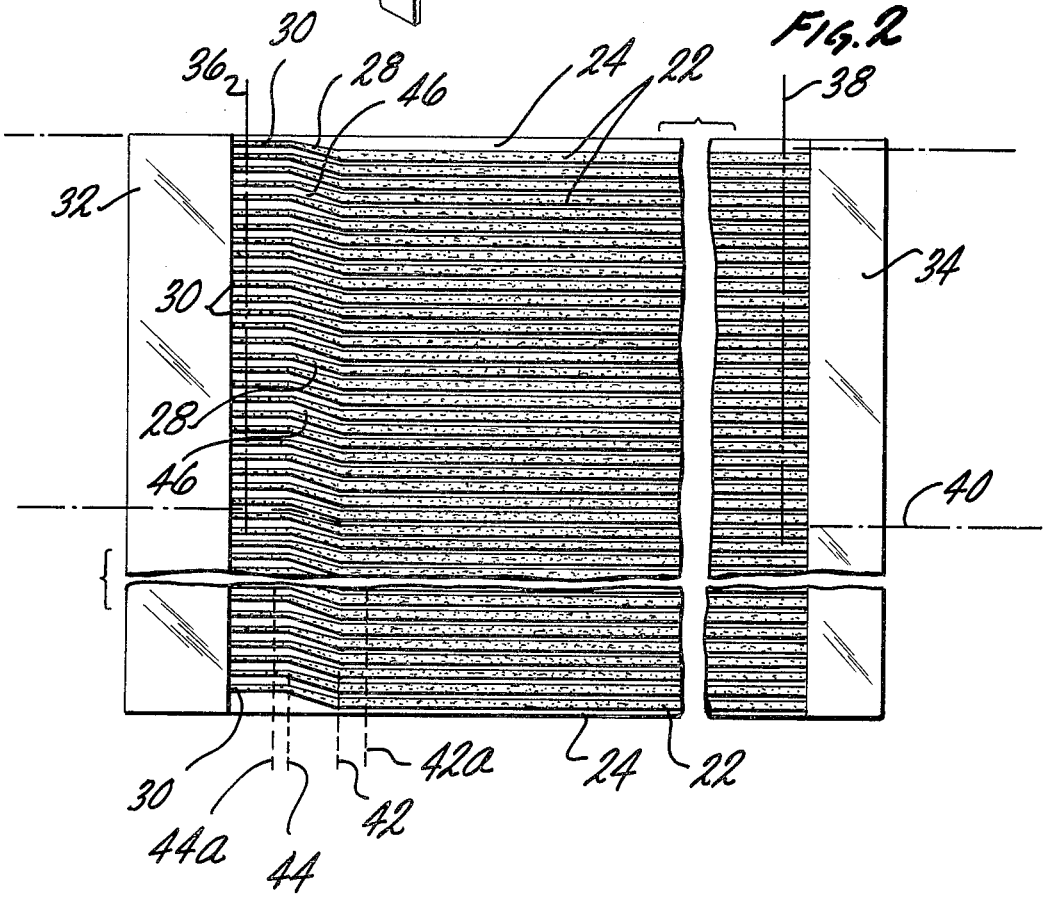
FIG. 2 is a plan view of the coil workpiece with the conductors etched thereon.

Turning now to FIG. 2, the first step in the formation of an electrical inductance coil, such as 14 or 16, is to form a plurality of flat, parallel, spaced apart copper strip conductors 22 on a suitable flexible dielectric substrate, such as Kapton, to provide a coil blank or workpiece 26 with exposed conductors. The cross-section of these copper strip conductors are substantially rectangular whose area is selected according to the current to be carried therethrough and are formed by etching using a conventional printed circuit board technique as mentioned above. The term "substantially rectangular" is selected because of the fact that the cross-section of the conductors differs slightly from true rectangularity due to the consequences of etching the conductors on the dielectric substrate.

The number of conductors selected depends upon whether or not more than one coil is to be made out of the workpiece. Each conductor angles off diagonally, as at 28, but still maintaining general parellelism with each other, a distance which will depend on the desired spacing of the turns of the coil so that the narrower terminal end 30 of each conductor is offset and in alignment with its adjacent conductor while still parallel to the remainder or main body of the conductors. The exposed conductors may be provided with solder throughout their length for later flow-soldering in one of the later steps in the process, or not covered at all with solder for one of the later steps, as will be clear hereinafter.

Next, the tie-bars 32 and 34, formed on the circuit board during the circuit board process, are cut off, as at 36 and 38, and the number of conductors for the coils are selected and thus the workpiece 26 is cut as at 40 from the larger workpiece. This, of course, depends on whether or not the workpiece was originally selected so as to form more than one coil therefrom and which of the cuts 32 and 34 or 36 and 38 occurs first is not material.

Figure 3:
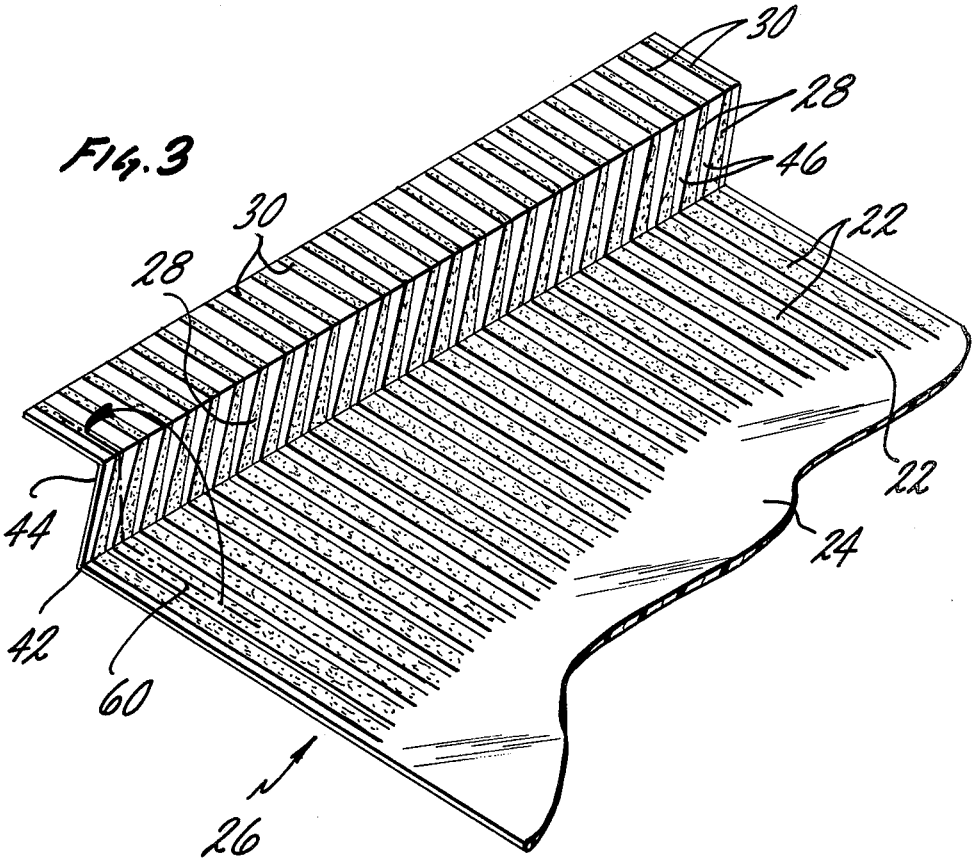
FIG. 3 is a perspective view of the coil workpiece showing some of the bends therein showing the overlapping of conductors to form the coil.
Figure 4:
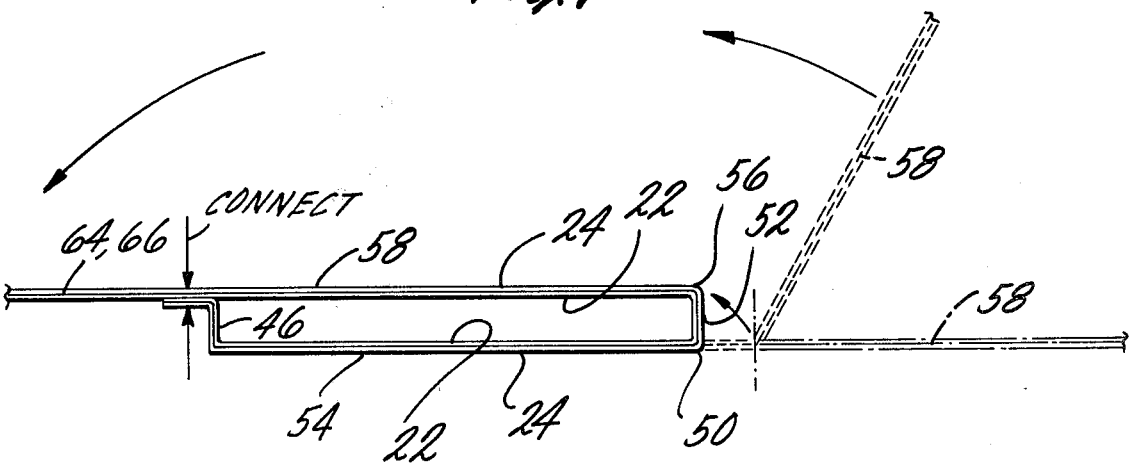
FIG. 4 is a side view of the coil and a showing of the steps in the formation thereof.
Figure 5:
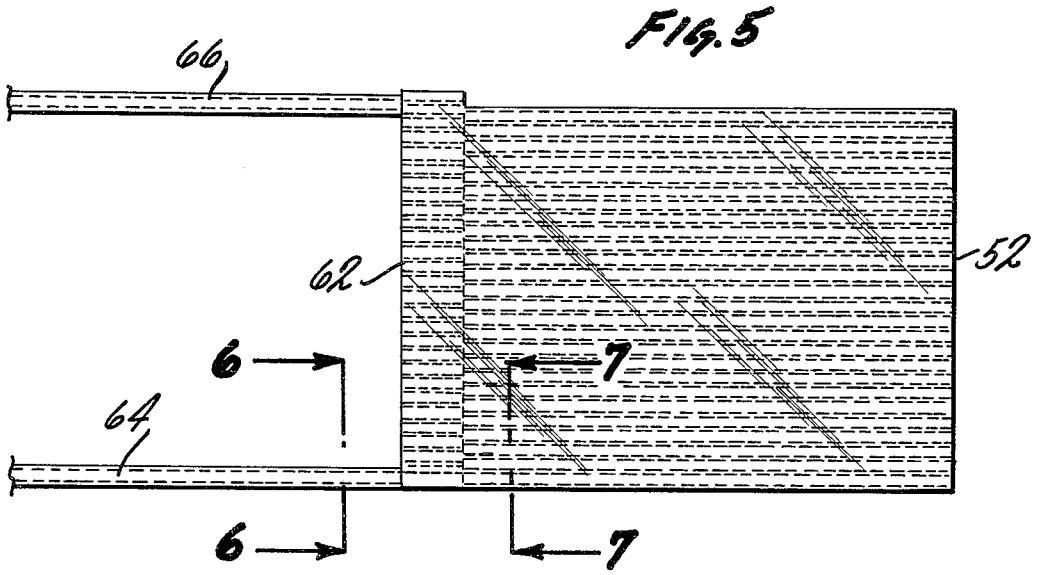
FIG. 5 is a plane view of the finished coil.

The next step can be best viewed in FIGS. 2, 3, and 4 taken together where the beginning of the portion containing the diagonal conductors 28 represents one bend line or zone 42 and end of the portion containing the diagonal conductors forms another bend line or zone 44 in the formation of the coil. Bend line 44 sets the ling along which a bend can be made to avoid an electrical shorting of the conductors in the final form of the coil. The bending can be selected to occur at other lines or zones and away from the portion containing the diagonal conductors, as for example at bend lines 42*a* and 44*a*. The criteria is that the portion containing the diagonal conductors 28 should be contained within the bend lines or zones and the other bend lines or zones can occur along the main body of the conductors or the terminal ends 30. In this step, the portion having the diagonal conductors 28 is formed with a compound bend at bend lines or zones such as 42 and 44, so that an end wall 46 is formed substantially at right angles to the portion containing the terminal ends 30 and the remainder or main body of the conductors and the portion containing the terminal ends 30 is substantially at right angles to the end wall 46 and parallel to the main body, with the conductors facing in the same direction. Again, the height of the terminal ends 30 relative to the main body of the conductors determines the thickness or spacing of the coil in which the core or sub-assembly is to be enclosed. Too, the terms bend "line" and "zone" are used since the bend itself may not be a well-defined sharp line but may have a radius of curvature. Thus the end wall 46 may not be a plane but a slightly curved end wall. This definition also applies to all subsequently referred to "walls" and bend "lines" and "zones".

In the next step, the conductors are again bent at a bend line or zone 50 at a distance from the first end wall 46 to form a second end wall 52 and a first side wall 54 of the coil. The length of this first side wall 54 is determined by the core or sub-assembly size which will be within the coil. The thickness of this second end wall 52 is the same as the first end wall 46 and the conductors are again bent at bend line or zone 56 to form a parallelelepiped (substantially) with a second side wall 58 and with the conductors facing the conductors in the first and second side walls. The remaining conductors of the main body overlap the terminal ends and extend beyond as shown at 60 in FIG. 4.

Figure 6:
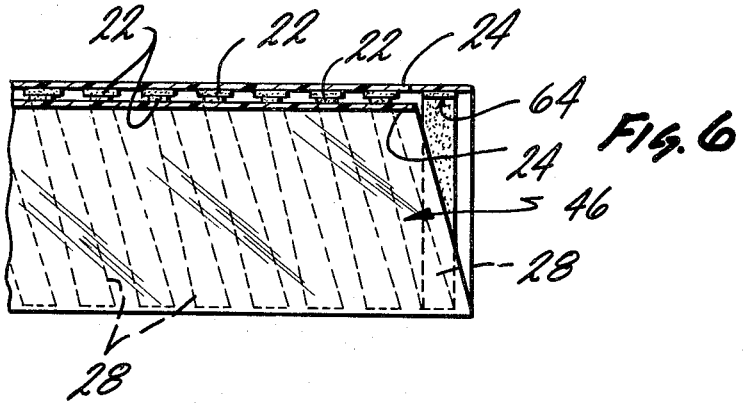
FIGS. 6 and 7 are views of the overlapping conductors taken along lines 6—6 and 7—7 of FIG. 5.
Figure 7:
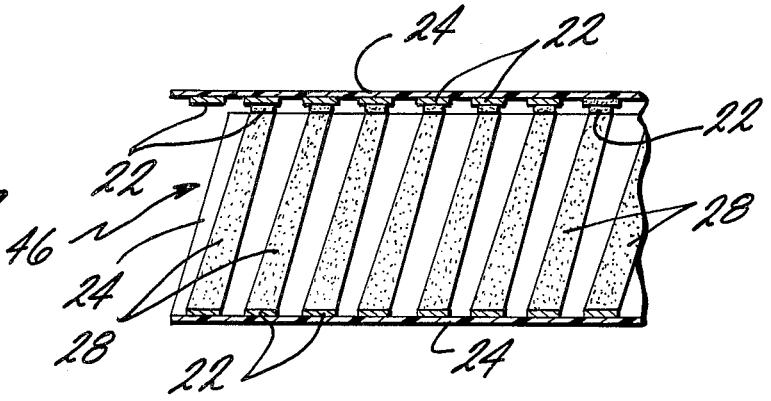

The next step in the formation of the coil is to connect the overlapping terminal ends 30 to the conductors of the second side wall 58. The significance of the diagonals 28 is now realized; that is to say, the diagonals 28 position the terminal ends 30 of each of the conductors such that a continuous coil is formed when the ends are connected to adjacent conductors, respectively, of the conductors of the second side wall. This is shown clearly by the center-line 60 in FIG. 3 and by the views of the end wall 46 in FIGS. 6 and 7. As mentioned above, the means for connecting the overlapping terminal ends to the adjacent conductors may be by flow soldering, but on the other hand, any suitable connecting means may be used such as welding.

Finally, all the conductors are trimmed to the portion containing the terminal ends 30 as at 62 except the outer two conductors as at 64 and 66 which are left to form the input and output conductors to the coil to be connected to a suitable power source. It is noted here that if the number of turns for the coil was not selected in the first step and the cut 40 was not then made, the cut 40 could be made at this time prior to trimming the coil as at 62.

From the foregoing it can be seen that a relatively thin-walled coil is formed in a unique manner. As a typical example of this invention in the bubble memory field, the size of the conductors is 0.016" times 0.009" on 0.001" Kapton. It should also be noted that the size and spacing of the conductor lines can be varied to control the magnetic field formed by the coil and the distributed capacitance of this coil at the time the conductor lines are formed on the dielectric substrate. This is a considerable improvement over the prior art where the control of a magnetic field by a wire wound coil can only be done by adding additional members of conductors where appropriate and perhaps with different wire sizes.

Finally, while the invention was disclosed as having the dielectric substrate on the outside of the coil as the preferred embodiment, it is within the scope of this invention to reverse this process so that the dielectric substrate is on the inside of the coil; it being only necessary to remove the dielectric substrate at the area where the terminal end portions 30 engage the adjacent conductors. Also, in connection with this latter process, it is also within the scope of the invention to have the dielectric substrate on both sides of the conductors so that the conductors are not exposed except where the dielectric substrate is removed in the portion where the terminal ends 30 engage the adjacent conductors.

What is claimed is:

1. An inductance coil comprising:

a plurality of spaced apart conductors disposed in parallel relationship on a flexible substrate;

each of said conductors consisting of two straight end portions and an interior diagonal portion, with said diagonal portion aligning one of said end portions with the opposite end portion of the next spaced apart conductor; and said flexible substrate being bent as a parallelepiped of any selectable cross section such that all of said aligned end portions are in face-to-face contact with each other to form said coil.

2. The inductance coil as claimed in claim 1 wherein said one end portion of said conductors is formed on an end wall substantially at right angles to the remainder of said conductors.

3. The inductance coil as claimed in claim 1 wherein a pair of end walls and a pair of side walls are formed by said conductors and wherein said substrate is located on the outside of said walls.

4. The inductance coil as claimed in claim 3 wherein said diagonal portions are located on one of said end walls.

5. The inductance coil as claimed in claim 3 wherein said conductors of one of said end walls are flow-soldered to the conductors of one of said side walls.

6. The inductance coil as claimed in claim 3 wherein said conductors of one of said end walls are welded to the conductors of one of said walls.

7. The inductance coil as claimed in claim 1 wherein said conductors, while parallel are non-uniformly spaced from each other to vary the pitch of the coil.

8. The inductance coil as claimed in claim 1 wherein the first and last conductors of said plurality form connecting means for connecting said coil to a power source.

9. An improved printed-circuit coil comprised of an array of spaced-apart conductor segments disposed in parallel on a thin flexible fold-able dielectric sheet means adapted to be folded-back upon itself re-entrantly in a prescribed "fold-direction", wherein:

each segment consists of a pair of rectilinear parallel end-portions interspersed with at least one interior rectilinear skew-portion;

the end-portions of each segment being disposed relatively parallel with all other end-portions along said prescribed "fold-direction", each pair of end-portions being offset in a "coil-axis direction" transverse to the "fold-direction", by a pitch-distance establishing turn-pitch;

the skew-portion(s) intermediate each pair of such end-portions being inclined at a prescribed acute angle relative to this "fold-direction" sufficient to, in the aggregate, generate the associated offset pitch-distance in said "coil-axis direction";

the sheet folded along said "fold direction" as to register one end-portion of a given segment with the opposite end-portion of another prescribed adjacent segment, with these ends joined in face-to-face ohmic continuity to render a prescribed multi-turn helical coil.

* * * * *